US005890823A

United States Patent [19]

Chang et al.

[11] Patent Number: 5,890,823

[45] Date of Patent: Apr. 6, 1999

[54] SERVICE STATION WIPING MECHANISM IN A PRINTING UNIT

[75] Inventors: Shyi-Huang Chang, Taipei; Hui-Sheng Chu, Taipei Hsien, both of Taiwan

[73] Assignee: Sampo Corporation, Taipei, Taiwan

[21] Appl. No.: 917,732

[22] Filed: Aug. 27, 1997

[51] Int. Cl.[6] ..... B41F 35/00

[52] U.S. Cl. ..... 400/702.1; 347/33

[58] Field of Search ..... 400/701, 702, 400/702.1; 347/22, 23, 29, 33

[56] References Cited

U.S. PATENT DOCUMENTS

| | | | |
|---|---|---|---|
| 4,930,914 | 6/1990 | Hulterstrum et al. | 400/109.1 |
| 5,151,715 | 9/1992 | Ward et al. | 347/33 |
| 5,627,573 | 5/1997 | Fahy | 347/29 |
| 5,648,803 | 7/1997 | Koyama et al. | 347/30 |

*Primary Examiner*—Ren Yan
*Attorney, Agent, or Firm*—Rosenberg, Klein & Bilker

[57] ABSTRACT

A type of service station wiping mechanism for a printing unit, including a fixing seat that is fitted at one end of the printing unit. On said fixing seat is fitted a solenoid and on said solenoid is a spindle. One end of said spindle is joined to a crank, and on the crank is a pushing tapered plane, when the crank moves horizontally in the fixing seat is a wiping pad seat which will move vertically. On said wiping pad seat is fitted a wiping pad. The lower end of the wiping pad seat is resting against the pushing tapered plane on the crank. The solenoid drives the spindle to move the crank and control the wiping pad seat and the wiping pad to move up or down.

4 Claims, 7 Drawing Sheets

SERVICE STATION WIPING MECHANISM IN A PRINTING UNIT

BACKGROUND OF THE INVENTION

The subject invention relates to a type of service station wiping mechanism in a printing unit, particularly to one with such functions that will reduce the width of a printing unit, enable simplified construction, simplified assembling process, reduced production costs and preventing jamming occurrences, etc.

DESCRIPTION OF PRIOR ART

Conventionally, with the purpose to keep the spray nozzle in an ink spray head clean, a prior art ink spraying printing unit is generally equipped with a rubber wiping pad; said wiping pad may be so fixed that when the service station passes, the wiping pad will perform a wiping job on the spray nozzle in the ink spray head, to prevent the ink from depositing and keep the spray nozzle clean. However, said fixed type of wiping pad cannot rise or lower properly, so the width of the printing unit has to be lengthened to prevent the wiping pad from interfering with the printing operation. Another conventional version uses a motor as the driving source to drive the wiping pad to rise or lower by means of gears and levers, so that when the wiping pad is not in use, the wiping pad will properly rise or lower, so as to prevent the wiping pad from interfering with the printing operation. However, in this type of wiping pad, the construction of the motor, gear sets and levers employed to drive the wiping pad is very sophisticated and the assembling process is quite difficult, resulting in high production costs, and frequent jamming occurrences for such driving units as the gear sets and the levers, etc.

It is obvious from the above description that the service station wiping mechanism in a conventional printing unit does have inconveniences and weaknesses, in the sense of actual applications, that need improvement.

Therefore, to seek possible improvement on said weaknesses, the subject inventor has devoted much effort in the research, with technical applications, and has finally presented the reasonably designed subject invention with efficient improvement on said weaknesses.

SUMMARY OF THE INVENTION

The primary purpose of the subject invention is to provide a type of service station wiping mechanism in a printing unit, mainly comprising a solenoid that is fitted on the fixing seat at one end of the printing unit. In said solenoid is a spindle, and one end of said spindle is joined to a crank which can move horizontally. In the fixing seat is a wiping pad seat that can move vertically. On the wiping pad seat is fitted a wiping pad, while the lower end of the wiping pad seat is resting against a pushing tapered plane formed on the crank. The solenoid serves to drive the wiping pad to rise or lower, so that when the wiping pad is not in use, the wiping pad can be controlled to properly rise or lower, so that the wiping pad will not interfere with the printing operation. Meanwhile, the invention's simple construction and easy assembling will reduce the production costs, and effectively prevent jamming occurrences.

To enable better understanding of the characteristics and technical contents of the subject invention, please refer to the following detailed description with drawings; however, the attached drawings are only for the purposes of reference and description, and should not be based to restrict or limit the subject invention:

BRIEF DESCRIPTION OF NUMERALS

Figure 1:
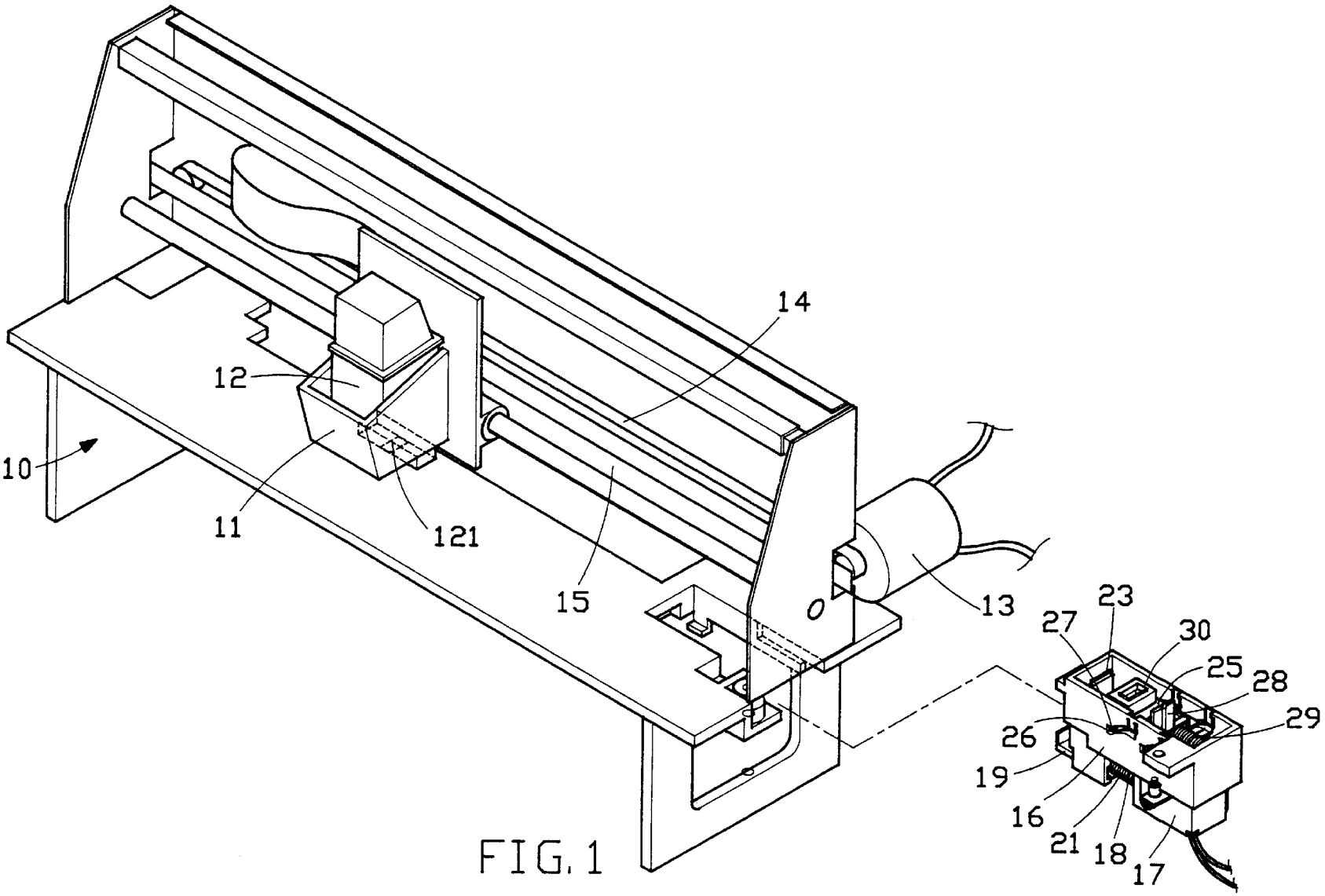
FIG. 1 is a perspective assembled view of the subject invention.

10 printing unit 11 service station
12 ink spray head 13 motor
14 belt 15 guide rail
16 fixing seat 17 solenoid
18 spindle 19 crank
20 pushing tapered plane 21 compression spring
22 wiping pad seat 23 wiping pad
24 catch hook 25 spray nozzle hood seat
26 slide key 27 slide trough
28 push piece 29 reset spring
30 spay nozzle hood

DETAILED DESCRIPTION OF PREFERRED EMBODIMENT

Figure 2:
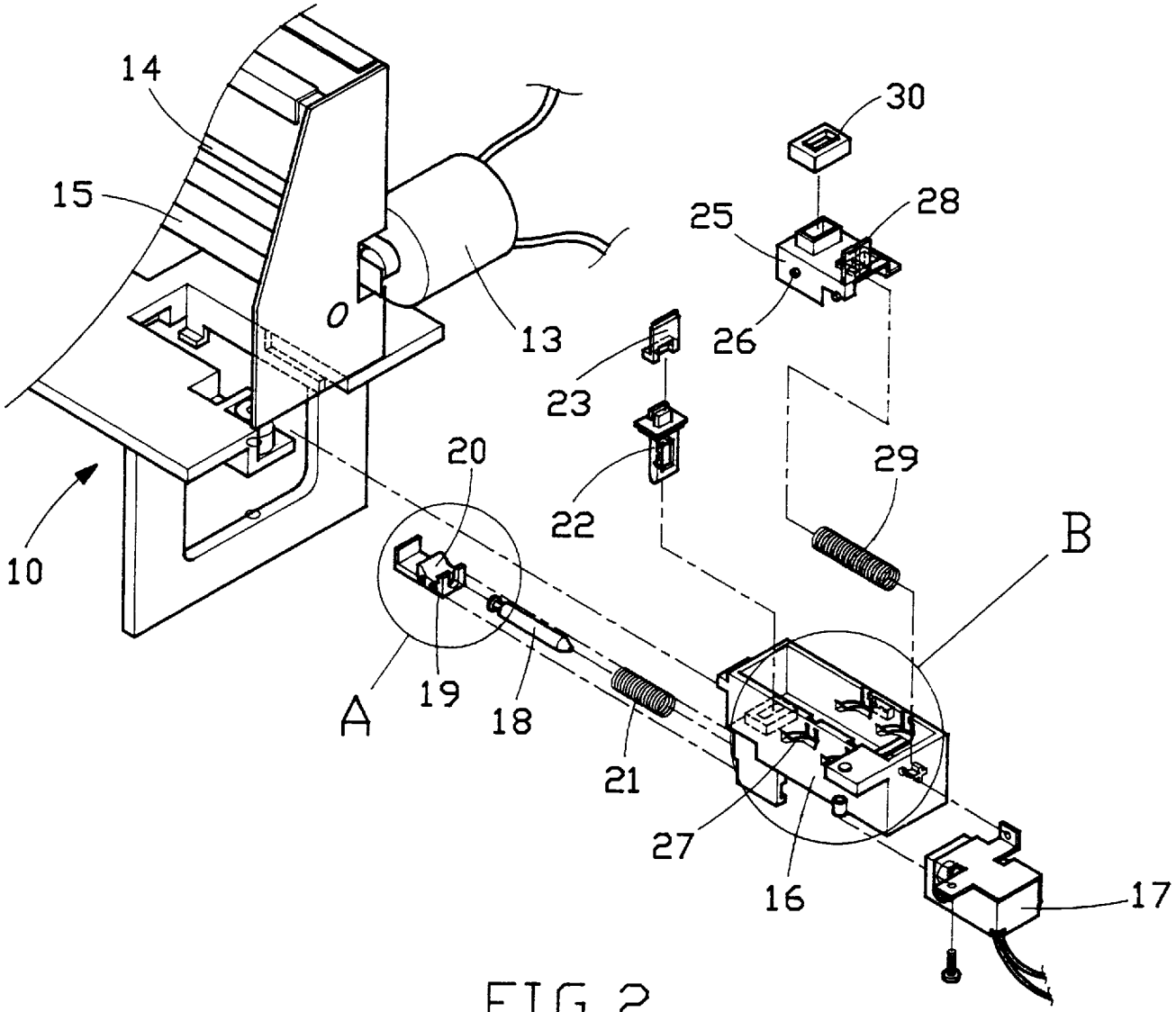
FIG. 2 is a partially exploded view of the subject invention.
Figure 2A:
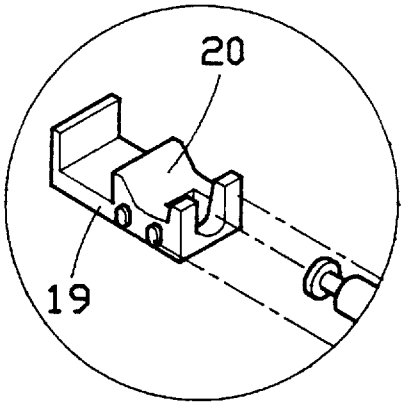
FIGS. 2A and 2B are partial enlargement view of the subject invention.
Figure 2B:
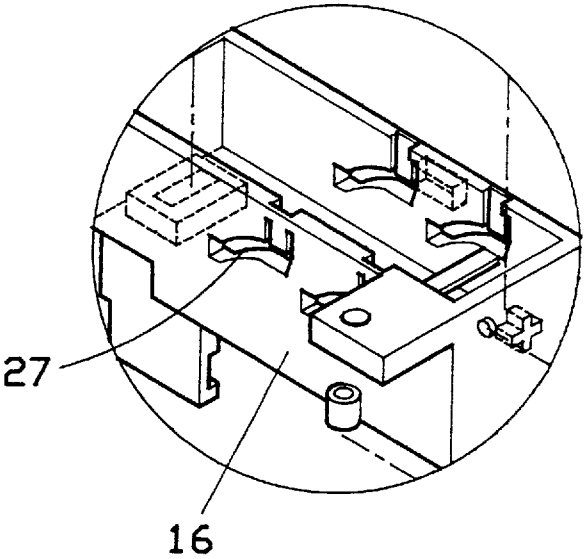
Figure 3:
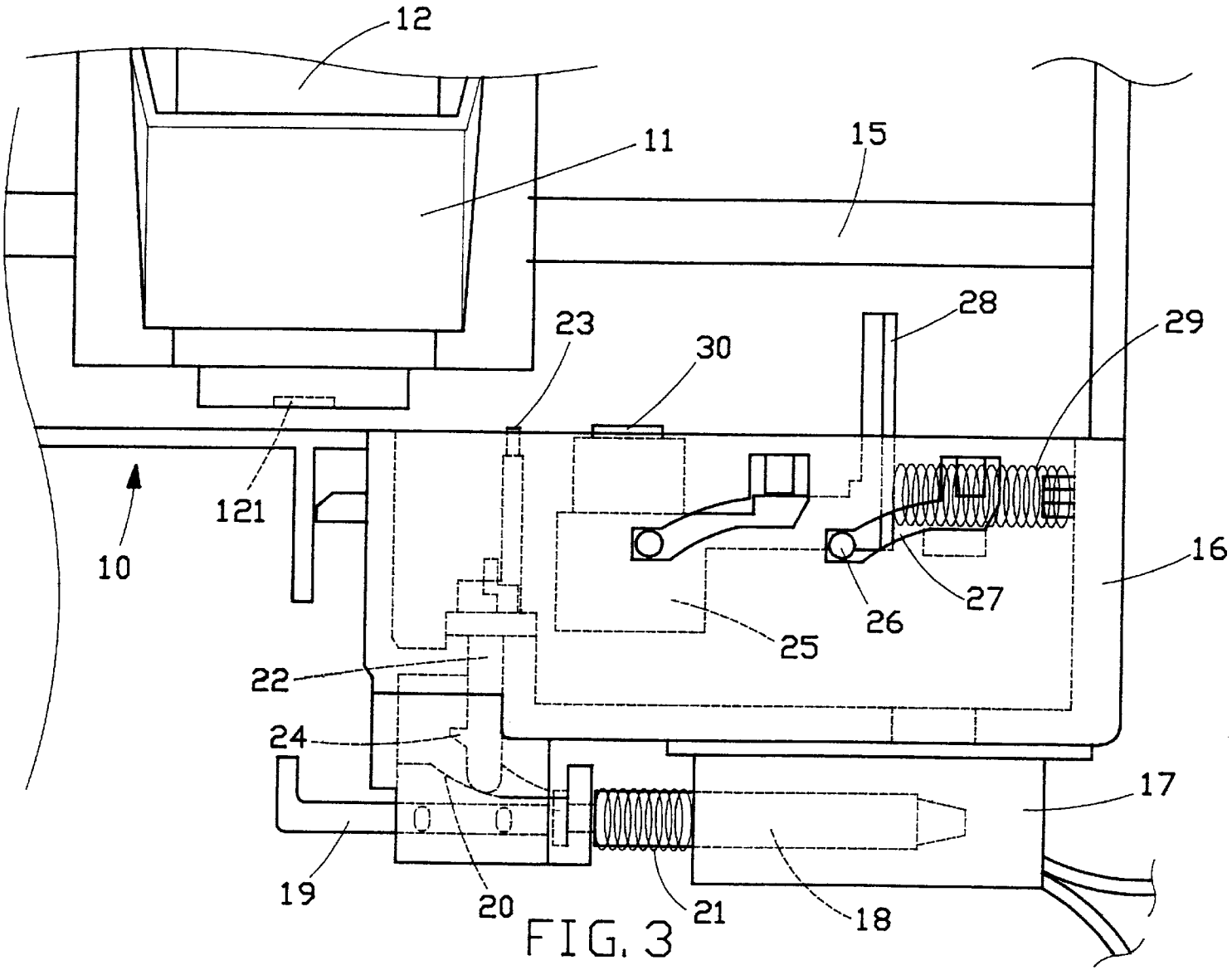
FIG. 3 is a plane view of the subject invention.

Please refer to FIGS. 1, 2 and 3 which are respectively the perspective assembled view, a partially exploded view and a plane view of the subject invention. The subject invention relates to the providing of a type of service station wiping mechanism in a printing unit. Said printing unit 10 includes a service station, which includes an ink spray head 12. The service station 11 is driven by a driving device of motor 13 and belt 14 to move from left to right and vice versa on a guide rail 15, so that the spray nozzle 12 on the bottom of the ink spray head 12 will perform an ink spray printing operation.

At one end of the printing unit 10 is a fixing seat 16. On the bottom of said fixing seat 16 is a solenoid 17, and inside the solenoid 17 is a spindle 18. One end of said spindle 18 is joined to a crank 19 and on the crank 19 is formed a pushing tapered plane 20. Said crank 19 is slide fitted to the bottom of the fixing seat 16 so as to move horizontally; between the crank 19 and the solenoid 17 may be fitted a compression spring 21. In the fixing seat 16 is slide fitted a wiping pad seat 22 which will move vertically, while on said wiping pad seat 22 is a wiping pad 23 that is made of rubber. Near the bottom of said wiping pad seat 22 is a catch hook 24, to prevent the wiping pad seat 22 from moving upward and out of the fixing seat 16. The lower end of the wiping pad seat 22 is resting on the pushing tapered plane 20 on the crank 19.

Figure 4:
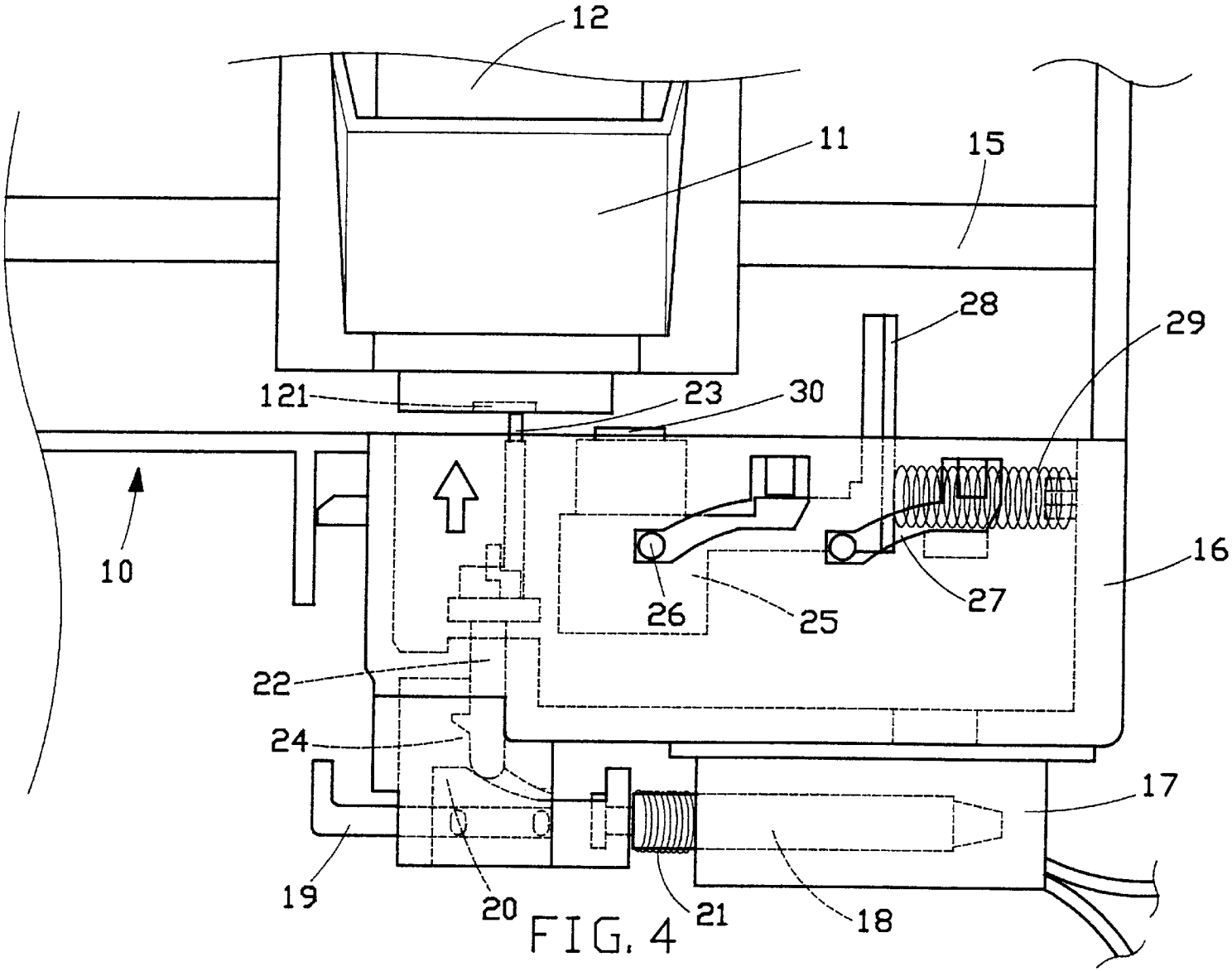
FIG. 4 is an illustration of the subject invention in operation.

Please refer to FIG. 4, which is an illustration of the subject invention in operation. The subject invention involves a circuit control unit which controls an appropriate current input to the solenoid 17. The magnetic field produced by the input current in the solenoid 17 will drive the spindle 18 to move to the right, so as to pull the crank 19 on which the pushing tapered plane 20 will push the wiping pad seat 22 and the wiping pad 23 to rise to an appropriate height, so the wiping pad 23 is activated into a wiping mode. When the service station 11 passes, the wiping pad 23 will perform a wiping action on the spray nozzle 121 on the bottom of the ink spray head 12, so to keep the spray nozzle 121 clean. When the input current in the solenoid 17 is interrupted, the wiping pad seat 22 and the wiping pad 23 will automatically lower to their reset position by means of their gravitational weight and the pushing of the spray nozzle 121.

The service station's wiping mechanism according to the subject invention unit includes a solenoid 17 which will properly control the wiping pad 23 to rise or lower so that when the wiping pad 23 is not in use, the wiping pad can be controlled to lower down properly, so that the wiping pad 23 will not interfere with the printing operation. Furthermore, the invention's simple construction and easy assembling process will significantly reduce the production costs, while it will effectively prevent the jamming of motor, gear set, levers and such driving units.

In the fixing seat 16 at one end of the printing unit 10 is a spray nozzle hood seat 25. On said spray nozzle hood seat 25 is fixed a spray nozzle hood 30 that is made of rubber. The spray nozzle hood seat 25 is slide fitted in the fixing seat 16, and protruding on two opposite sides of the spray nozzle hood seat 25 is a slide key 26. Said slide key 26 is slide fitted in the slide trough 27 on either side of the fixing seat 16. Each slide trough 27 is formed in an arc shape that gradually elevates to the right. Protruding on top of the spray nozzle hood seat 25 is a push piece 28. Between the spray nozzle hood seat 25 and the fixing seat 16 is a reset spring 29. Thus, a spray nozzle hood device is configured.

Figure 5:
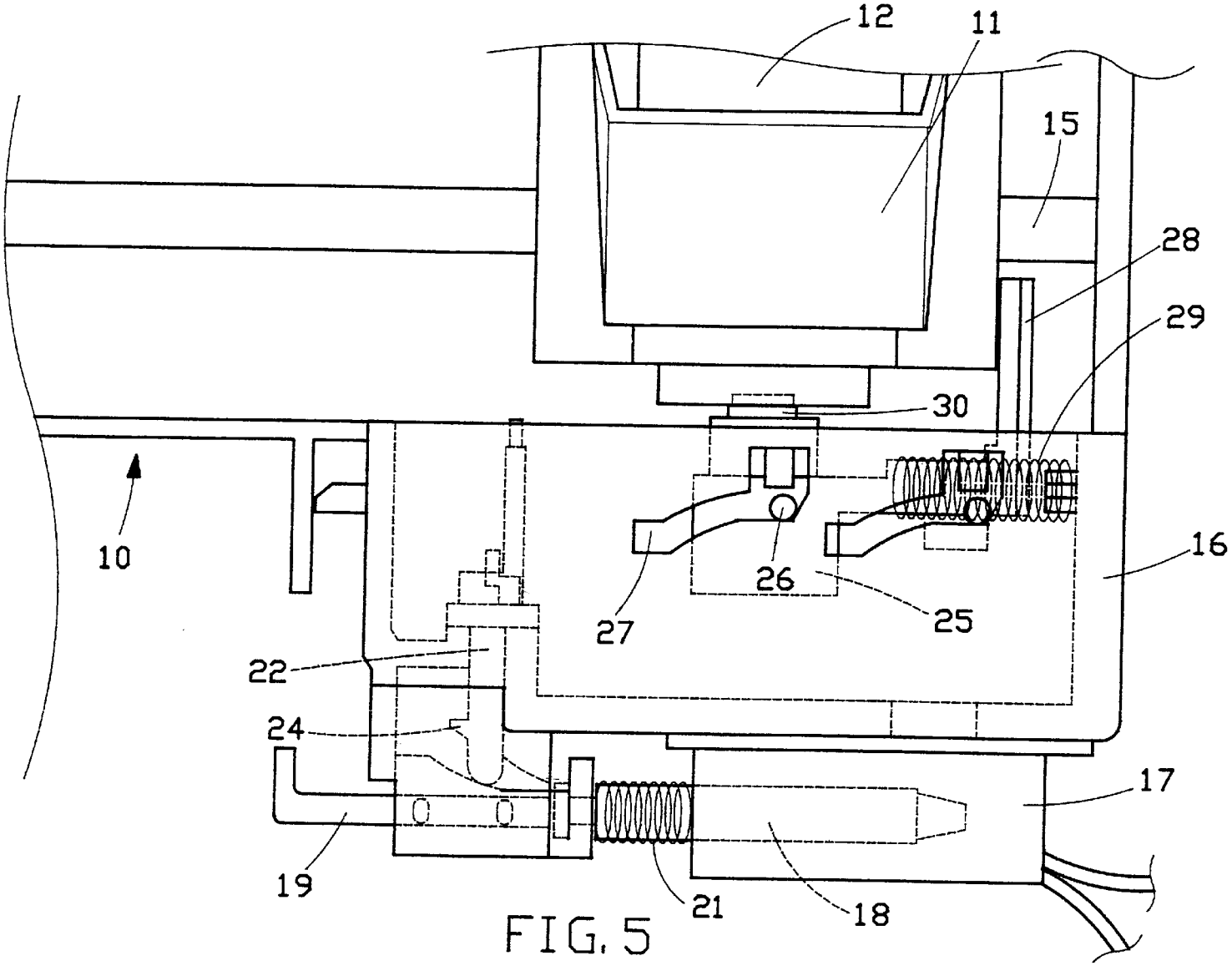
FIG. 5 is another illustration of the subject invention in operation.

Referring to FIG. 5, which is an illustration of the subject invention in operation, when the printing unit 10 is not in use and the service station 11 moves to the right (to its reset position), the service station 11 will push the push piece 28 and the spray nozzle hood seat 25 to the right. The slide key 26 at each side of the spray nozzle hood seat 25 moves to the right inside the slide trough 27, to drive the spray nozzle hood seat 25 to move upward. Then, the spray nozzle hood 30 on the spray nozzle hood seat 25 seals the spray nozzle 121 on the bottom of the ink spray head 12, so that the spray nozzle 121 is properly sealed when not in use.

Summing up, the subject invention, with improvements on such weaknesses as sophisticated construction, complicated assembling process, higher production costs, frequent jamming occurrences, etc. a conventional service station wiping mechanism for a printing unit, is indeed an unprecedented creation with its inventive step and originality that will fully satisfy the qualifications for a patent right; hence this application is filed in accordance with the Patent Law to protect the subject inventor's rights and interests.

It is hereby declared that the above description, covering the preferred embodiment, should not be based to limit or restrict the subject claim, and that all equivalent structural and/or configurational variations and/or modifications deriving from the subject description with drawings and contents therein, should reasonably be included in the intent of the subject invention and the subject claims.

What is claimed is:

1. A service station wiping mechanism for a printing unit comprising:

a fixing seat fittable to one end of a printing unit;

a solenoid fitted on the fixing seat;

a crank having a tapered plane formed thereon;

a spindle joined on a first end to the solenoid and joined on an opposite end to the crank, such that the crank may be moved in a horizontal direction by the solenoid;

a wiping pad seat mounted in the fixing seat and having a bottom end resting upon the tapered plane of the crank, such that the wiping pad seat is moved in a vertical direction when the crank is moved in the horizontal direction;

a wiping pad mounted on the wiping pad seat; and a catch hook fitted near the bottom end of the wiping pad seat, so as to prevent the wiping pad seat from being removed from the fixing seat.

2. The service station wiping mechanism recited in claim 1, wherein a compression spring is positioned between the crank and the solenoid.

3. The service station wiping mechanism recited in claim 1, wherein the fixing seat defines a slide trough in each of opposite sides thereof, the slide troughs being shaped to gradually elevate toward an end of the fixing seat opposite the wiping pad seat, and further including:

a spray nozzle hood seat positioned inside the fixing seat;

a spray nozzle hood fitted onto the spray nozzle hood seat; a slide key mounted on each of opposite sides of the spray nozzle hood seat, such that each slide key is slide fitted in one of the slide troughs;

a push piece protruding from a top of the spray nozzle hood seat; and a reset spring positioned between the spray nozzle hood seat and the fixing seat.

4. The service station wiping mechanism as recited in claim 1, wherein the wiping pad seat will automatically lower to its reset position by way of its own gravitational weight, when an input current for the solenoid is interrupted.

* * * * *